United States Patent [19]

Clayton

[11] 4,179,414

[45] Dec. 18, 1979

[54] FATTY ACID DIETHANOL AMIDE-CONTAINING GENERAL PURPOSE CLEANER IN PASTE FORM

[75] Inventor: William J. Clayton, Fairport, N.Y.

[73] Assignee: Mobil Oil Corporation, New York, N.Y.

[21] Appl. No.: 953,823

[22] Filed: Oct. 23, 1978

[51] Int. Cl.[2] ..... C11D 3/10; C11D 3/32; C11D 17/00

[52] U.S. Cl. ..... 252/548; 252/DIG. 1; 252/14

[58] Field of Search ..... 252/529, 548, 153, 117

[56] References Cited

U.S. PATENT DOCUMENTS

| | | | |
|---|---|---|---|
| 2,303,366 | 12/1942 | Katzman | 260/404 |
| 2,607,740 | 8/1952 | Vitale et al. | 252/153 |
| 2,870,091 | 1/1959 | Tomlinson | 252/548 X |
| 3,981,826 | 9/1976 | Munro | 252/526 |

FOREIGN PATENT DOCUMENTS

| | | | |
|---|---|---|---|
| 527522 | 7/1956 | Canada | 252/548 |
| 1047973 | 12/1958 | Fed. Rep. of Germany | 252/529 |
| 2060975 | 6/1971 | Fed. Rep. of Germany | 252/91 |
| 939366 | 10/1963 | United Kingdom | 252/529 |

*Primary Examiner*—P. E. Willis, Jr.

*Attorney, Agent, or Firm*—C. A. Huggett; J. F. Powers; H. S. Trigg

[57] ABSTRACT

There is provided a stable paste comprising a diethanolamide of a fatty acid having 12–16 carbon atoms, sodium bicarbonate, sodium chloride, and water. In another embodiment, this paste is admixed with a paste of the diethanolamide, sodium chloride, and a saturated solution of sodium chloride. Both formulations can be used full strength for scrubbing stubborn stains, scuff marks and the like and diluted for cleaning surfaces, such as floors and walls.

6 Claims, No Drawings

FATTY ACID DIETHANOL AMIDE-CONTAINING GENERAL PURPOSE CLEANER IN PASTE FORM

BACKGROUND OF INVENTION

1. Field of the Invention

This invention is directed to stable, paste-form general purpose cleaners.

2. Description of the Prior Art

In U.S. Pat. No. 3,759,847, there are described cleaning compositions containing fatty acid amides and soaps or detergents. Insofar as is now known the pastes of this invention have not been proposed.

SUMMARY OF THE INVENTION

This invention provides a stable paste comprising between about 50 and about 65 weight percent sodium bicarbonate and between about 50 and about 35 weight percent water, containing between about 5 and about 20 weight percent sodium chloride based on water and between about 10 and about 30 weight percent based on water of a diethanolamide of a fatty acid having about 12–16 carbon atoms.

It also provides an admixture of said stable paste and a second paste containing between about 55 and about 65 weight percent sodium chloride, between about 12 and about 16 weight percent of a diethanolamide of a fatty acid having about 12–16 carbon atoms, and between about 19 and about 33 weight percent water saturated with sodium chloride.

DESCRIPTION OF SPECIFIC EMBODIMENTS

The primary paste cleaning preparation contains between about 50 and about 65 weight percent sodium bicarbonate and between about 50 and about 35 weight percent water containing between about 5 and about 20 weight percent sodium chloride based on water and between about 10 and 30 weight percent based on water of a diethanolamide of a fatty acid having about 12–16 carbon atoms.

The amides utilizable in the paste composition of this invention are diethanolamides of fatty acids having about 12–16 carbon atoms. Such amides of mixtures of fatty acids in which the major proportion of the fatty acids have 12–16 carbon atoms are contemplated. A preferred amide is the diethanolamide of coconut oil fatty acids. These amides are commercially available.

As indicated hereinbefore, the optimum range of concentration of the amides is 10 to 30 weight percent of the water. Below this range, cleaning is not as good and long term stabilization is questionable. Above this range, there are no practical advantages. There are, however, three handicaps, (1) cost; (2) difficulty in rinsing off; and (3) loss of abrasiveness due to a lubricative effect of the amides.

The optimum amount of sodium bicarbonate is about 50 to about 65 percent of the total formula weight. Below this amount the formula is too thin and above this amount the formula is too thick for dispersing. A concentration of salt is between about 5 and about 20 percent of the aqueous phase. Less than 5 percent is not completely effective in stabilizing the paste. Above 20 percent the water phase becomes saturated at normal temperatures, and salt will crystallize out.

In general, the stable paste composition is prepared by admixing water with a diethanolamide and stirring in the sodium bicarbonate with high speed mixing. Thereafter, the sodium chloride is stirred in.

It is postulated that a small part of dry sodium bicarbonate dissolves sufficiently in the water phase to saturate the water. The remainder of the sodium bicarbonate is completely surrounded with molecules of the amide. Concentration of the amide is probably greater at the surface of the sodium bicarbonate particles, but there is no evidence of a tightly adhered surface coating. When the sodium chloride is added the amide salts out on the surface of the sodium bicarbonate particles and forms a coating which is effective in producing long term stability in this paste-like suspension.

When the paste is used full strength it has a scouring action like commercial scouring powders except that it is far less abrasive. The paste is suitable for use with stainless steel, plastic, and fiberglass sinks. When the paste is diluted about one quarter cup to a gallon of water, the resultant solution is utilizable for cleaning surfaces, such as floors and walls. When it is necessary to remove crayon and scuff marks, such marks can be scrubbed with the full strength paste, followed by washing with the diluted solution.

In another embodiment of this invention, the primary paste is admixed with a second paste containing between about 55 and about 65 weight percent sodium chloride, between about 12 and about 16 weight percent of diethanolamide of a fatty acid having about 12–16 carbon atoms and between about 19 and about 33 weight percent water saturated sodium chloride.

In preparing the second paste, alkanolamide at a temperature between 32° F. and about 300° F. is admixed with sodium chloride to form a heavy dough, then water saturated with sodium chloride is added. After addition of water the dough takes on a paste-like consistency.

Although the second paste has cleaning capabilities by itself, it is more feasible to admix the second paste with the primary paste. The most advantageous of such combination of the admixture is one having the major proportion of the primary paste. A preferred ratio of the mixture is three parts by weight of primary paste per part of second paste.

The second paste and the admixture of it with primary paste has all the advantageous properties described herein above with regard to the primary paste.

The following specific examples demonstrate the pastes of this invention and their preparation. In the examples all parts are parts by weight unless otherwise specified.

EXAMPLE 1

Water (100 parts) was admixed with 20 parts of the diethanolamide of coconut oil fatty acids. Then 180 parts of sodium bicarbonate was stirred in on high speed mixer (1800 RPM). Thereafter 20 parts of sodium chloride was stirred in. The resultant product was a paste which remained in stable suspension for up to six months.

EXAMPLE 2

The diethanolamide of coconut oil fatty acids (150 parts) was heated to 200° F. Then 600 parts of sodium chloride was stirred in to form a heavy dough. Finally 200 parts of water saturated with sodium chloride was added and the resultant admixture was stirred to form a paste-like material.

EXAMPLE 3

An admixture was made by stirring together three parts of the paste of Example 1 with 1 part of the paste of Example 2. Stirring was continued until the admixture was homogeneous, while still retaining its paste-like consistency.

Although the present invention has been described with preferred embodiments, it is to be understood that modifications and variations may be resorted to, without departing from the spirit and scope of this invention, as those skilled in the art will readily understand. Such variations and modifications are considered to be within the purview and scope of the appended claims.

What is claimed is:

1. A stable paste comprising between about 50 and about 65 weight percent sodium bicarbonate and between about 50 and about 35 weight percent water, containing between about 5 and about 20 weight percent sodium chloride based on water and between about 10 and about 30 weight percent based on water of a diethanolamide of a fatty acid having about 12–16 carbon atoms.

2. An admixture of said stable paste of claim 1 and a second paste containing between about 55 and about 65 weight percent sodium chloride, between about 12 and about 16 weight percent of a diethanolamide of a fatty acid having about 12–16 carbon atoms, and between about 19 and about 33 weight percent water saturated with sodium chloride, in a ratio of about 2 to 4 parts by weight of stable paste per part of second paste.

3. The stable paste of claim 1, wherein said diethanolamide is the diethanolamide of coconut oil fatty acids.

4. The admixture of claim 2, wherein said diethanolamide is the diethanolamide of coconut oil fatty acids.

5. The stable paste of claim 1 comprising about 56 weight percent sodium bicarbonate and about 31 weight percent water, containing about 14 weight percent sodium chloride based on water and about 14 weight percent based on water of a diethanolamide of coconut oil fatty acids.

6. The admixture of claim 2 of said stable paste and a second paste containing about 63 weight percent sodium chloride, about 16 weight percent of a diethanolamide of coconut oil fatty acids, and about 21 weight percent water saturated with sodium chloride, in a ratio of about 3 parts by weight of stable paste per part of second paste.

* * * * *